United States Patent [19]

Clemens

[11] Patent Number: 4,864,804

[45] Date of Patent: Sep. 12, 1989

[54] TRAINING HOPPLE FOR TROTTING HORSES

[76] Inventor: John E. Clemens, 1460 U.S. 35 East, Xenia, Ohio 45385

[21] Appl. No.: 181,371

[22] Filed: Apr. 14, 1988

[51] Int. Cl.[4] ..... B68B 1/00

[52] U.S. Cl. ..... 54/71

[58] Field of Search ..... 119/126, 127, 128; 54/2, 71

[56] References Cited

U.S. PATENT DOCUMENTS

| | | | |
|---|---|---|---|
| 161,461 | 3/1875 | Walling | 119/128 X |
| 444,032 | 1/1891 | Whitaker | 54/71 |
| 497,326 | 5/1883 | Kitterman | 119/128 |
| 580,965 | 4/1897 | Weathers | 54/71 |
| 741,023 | 10/1903 | Filbey | 119/126 |
| 1,212,023 | 1/1917 | Curley | 119/128 |
| 1,455,341 | 5/1923 | Kopf | 119/128 |
| 2,500,079 | 3/1950 | Jackson | 54/71 |
| 2,697,902 | 12/1954 | Empie | 54/71 |
| 2,761,266 | 9/1956 | Hobkirk | 54/71 |
| 2,814,923 | 12/1951 | Knauss | 54/71 |
| 3,174,261 | 3/1965 | Calderhead | 119/126 |
| 3,824,764 | 7/1979 | Roberts | 119/126 |
| 4,389,835 | 6/1983 | Kavalieras | 119/126 |

*Primary Examiner*—Robert P. Swiatek

*Attorney, Agent, or Firm*—Dowell & Dowell

[57] ABSTRACT

A hopple for developing a trotting gait for horses which includes two sets of diagonally disposed hopple loops which encircle a horse's legs and which are connected so as to fetter the horse's legs diagonally through a motion transfer assembly mounted beneath the horse's belly and which assembly permits the front and rear legs of the horse to be linearly restrained so that the legs are diagonally fettered without the imposition of lateral stress.

21 Claims, 5 Drawing Sheets

FIG. 4
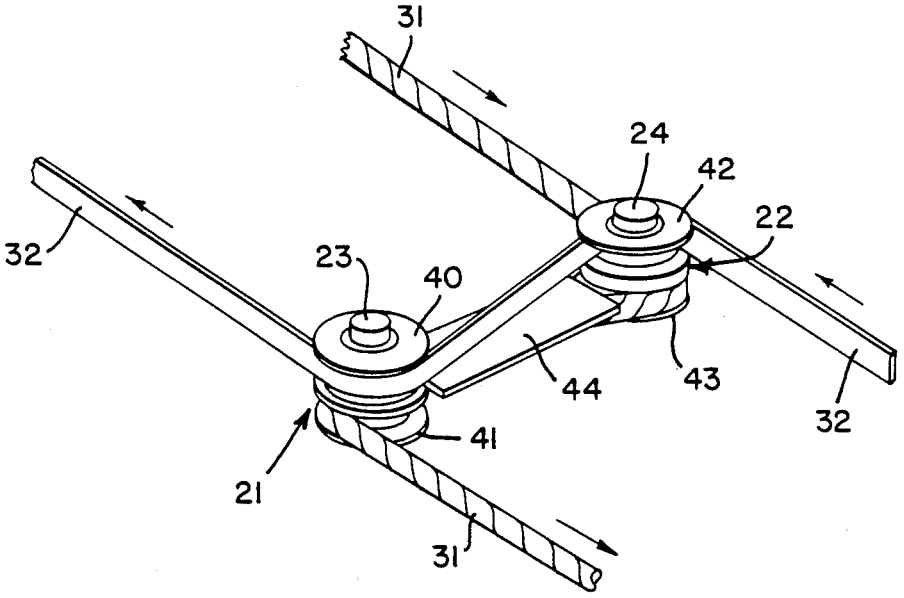
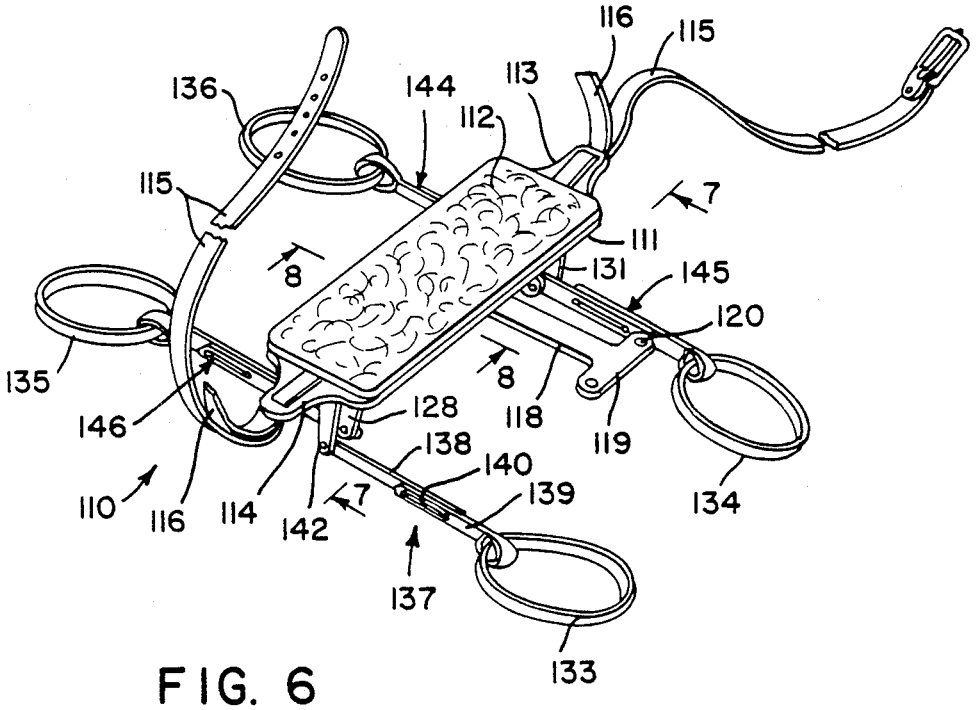
FIG. 6

FIG. 7
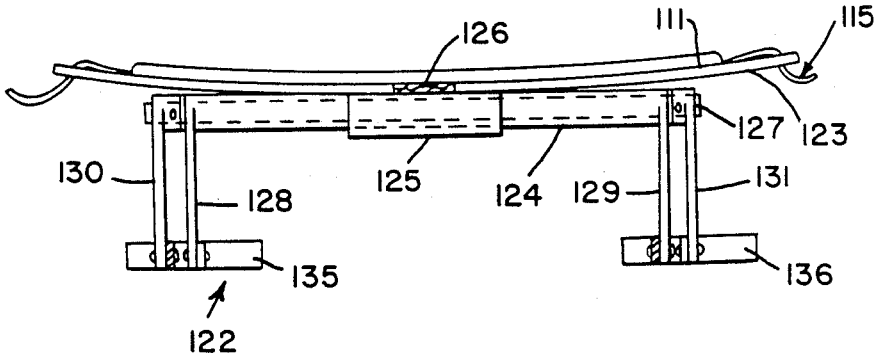
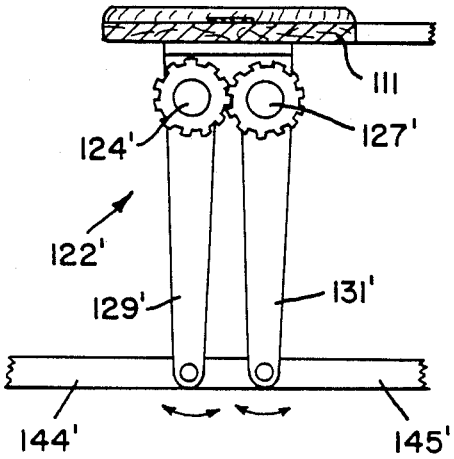
FIG. 9
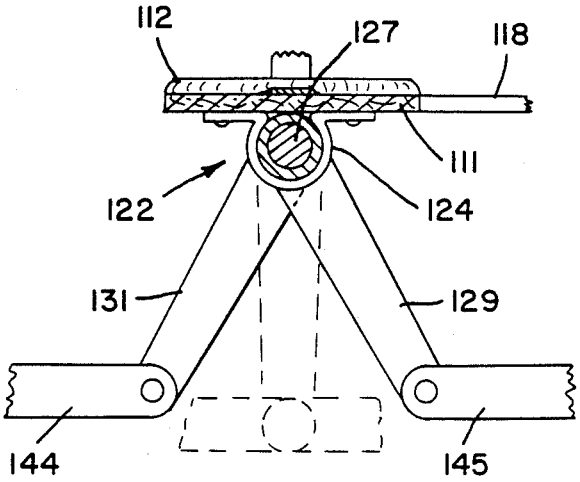
FIG. 8
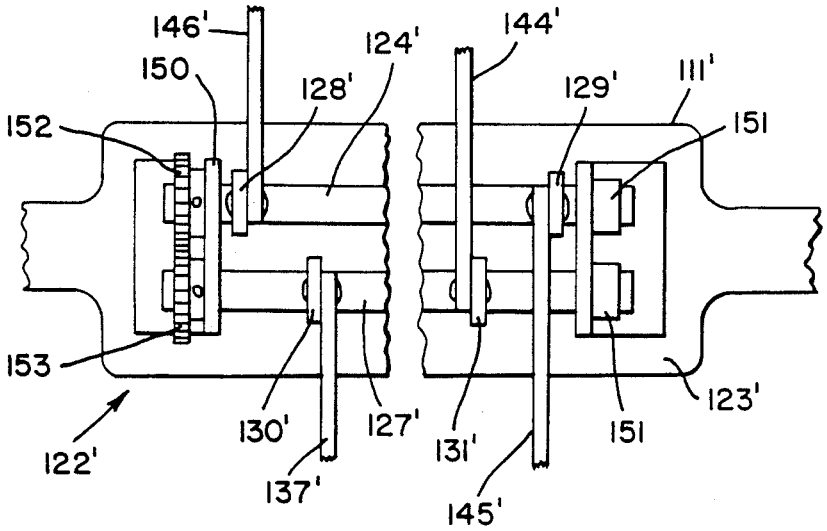
FIG. 10

TRAINING HOPPLE FOR TROTTING HORSES

BACKGROUND OF THE INVENTION

1. Field of the Invention

This invention is generally directed to hopples used for training and controlling a horse's gait and more particularly to a hopple for developing the diagonal gait of a trotting horse. With the hopples of the present invention, the diagonal front and rear legs of the horse are fettered so that the connected legs are somewhat constrained and the only comfortable gait for the horse is a trot. The hopples also provide motion transfer mechanisms or assemblies which enable the constraint in the horse's gait to be directed in a linear manner with respect to the normal motion of the horse's legs and thereby prevents potentially damaging lateral forces or stresses from being exerted on the horse's legs.

2. History of the Related Art

It has heretobefore been known to use hopples to regulate the gait of race horses. The original hopples were conceived to regulate the gait of pacing horses by providing straps or other structures which would tie the front and rear legs on the same side of the horse so that the legs would move in unison. Although there have been numerous designs and structures created for use in training and racing pacing horses, each of the hopples generally includes similar operative structure. The basic pacing hopple includes two pairs of front and rear loops which are of a size to encircle the upper portion of the legs of a horse and which are connected by an adjustable belt or other strap-like component. The loops and straps are suspended from the horse by harness or hanger members which are disposed over the horse's fore and hind sections adjacent the loops. The two pairs of front and rear hopple loops are therefore mounted in generally parallel relationship with the forward loop encircling one forward leg and the rear loop encircling the rear leg on the same side of the horse. In order to adjust the hopple to the stride or stroke of the gait of the horse, the tie between the loops may be shortened or lengthened or the loops may be vertically adjusted by altering the position or length of the hanging straps with the linear motion of the hopple loops becoming less and less as the hopple is raised relative to the horse's legs.

Prior art pacing hopples not only serve to regulate the gait of a horse so that the front and rear legs on one side move simultaneously but they also restrict the horse's gait from developing into a gallop as the horse's legs are not free and are impeded from developing such a gait. On the other hand, the hopple loops are generally constructed so as to provide sufficient slack so that the horse may walk at a slow rate in a fairly conventional manner. Due to the success of pacing hopples, such hopples are currently used throughout the racing industry both as a training aid and as a racing implement.

Some examples of prior art pacing hopples are disclosed in U.S. Pat. Nos. 497,326 to Kitterman, 741,023 to Filbey, 1,212,023 to Curley, 1,455,341 to Kopf, 2,500,079 to Jackson, 2,697,902 to Empie, 2,761,266 to Hobkirk, 3,174,261 to Calderhead, 3,824,764 to Roberts and 4,389,835 to Kavalieros.

Although hopples for use with pacing horses have achieved an overwhelming level of acceptance both in the training and racing industry, the same cannot be said of hopples for use in training and racing trotting horses. The gait of a trotting horse differs from that of a pacing horse in that the diagonal front and rear legs of the horse are to move in unison as opposed to the same side front and rear legs moving in unison in a pacing gait. Prior attempts to simply bind the diagonal legs of the horse together utilizing adjustable straps have not proven to be successful because the diagonal straps tend to rotate the hopple loops to the same diagonal angle which interferes with the gait of the horse. Also, the diagonal straps crossing each other while in rapid motion cause considerable friction which impedes the horse and the legs are bound so that stresses are created diagonally with respect to the normal gait of the horse. That is, by diagonally securing the legs together, stresses and forces are created laterally with respect to the normal front and rear motion of the legs. Such stresses not only tend to take the horse out of a proper gait but can be extremely unsafe and potentially damaging to a horse.

An example of one type of prior art trotting hopple is disclosed in U.S. Pat. No. 2,814,923 to Knauss. This hopple utilizes a system having a front and rear pulley around which ropes or straps pass to a pair of front and a pair of rear hopple loops which are positioned about the front and rear legs of the horse. The entire assembly is strapped to the horse so as to be suspended from the belly. With this structure, the two front legs are tied so that when one front leg moves forward, the opposing front leg must be moved rearwardly as the connecting strap or rope moves relative to the forward pulley. In a like manner, the rear legs are connected together utilizing a strap member passing around the rear pulley so that when one rear leg moves forwardly or rearwardly with respect to the opposing leg, the opposing leg must move in the opposite direction. With this structure, the same lateral stress is created with respect to the horse's legs as if the straps were connected diagonally across the horse. Therefore, the pull with respect to the horse's legs is toward the center point of the pulleys and is not in line with the normal forward and rearward motion of the horse's gait. Therefore, with this type of hopple, stresses are created which may be potentially dangerous to the horse as the hopple loops are connected so as to control the motion of the legs by exerting restrictive forces that are directed laterally with respect to the forward and rear motion of the legs. In addition, this pulley hopple configuration in no manner restricts the horse from either pacing or trotting. Either can be accomplished with ease. It does inhibit the horse from assuming the galloping gait.

In view of the foregoing, prior to the present invention, there has not been a successful trotting hopple utilized which has become acceptable for training and racing purposes.

SUMMARY OF THE INVENTION

This invention is directed to hopples for use in developing and controlling the trotting gait of horses wherein the hopples include two pairs or sets of diagonally disposed front and rear loops which are of a size to loosely encircle the upper portion of a horse's legs. Each pair of diagonally disposed loops is connected by loop lines which may include straps, ropes or linkages of various materials which are oriented so as to exert restrictive forces which are generally in alignment with the normal motion of the horse's legs. That is to say, that such loop lines are oriented in line with the normal forward and rearward motion of the legs at a normal gait. In one embodiment of the invention, a pair of rotatable shafts are carried by a mounting pad that is adapted to be secured by straps around the barrel of the horse or the shafts of the sulky or both. The rotation shafts of the hopple assembly are preferably mounted concentrically with one shaft inside the other and oriented generally perpendicular to the length of the horse. Pairs of opposing crank arms or levers are mounted so as to extend downwardly from each end of the shafts with the loop lines from one front leg loop of the hopple being connected to one of the levers with the diagonally opposing lever on the same shaft. The levers are oriented outwardly with respect to the center of the horse so that the loop lines extend generally parallel to the front and rear legs. In this manner, the diagonal legs are fettered so as to cause the diagonal pair of legs of the horse to move in unison and with any restrictive forces being oriented or extending generally linear to the forward and rearward motion of the horse's legs. The horse is therefore confined to a trotting gait without the application of adverse stress to the horse's legs.

In another embodiment, the shafts disposed beneath the belly of the horse may be oriented in spaced generally parallel relationship to one another and geared together so that all four legs of the horse are mechanically restrained to move uniformly with respect to one another in a proper trotting gait.

In the preferred form of the invention, the hopple loop lines are generally continuous between the diagonal legs of the horse with each loop line passing about a pair of horizontally oriented pulleys which are secured to a housing that is mounted beneath the horse's belly. The pulleys are mounted a sufficient distance apart so that the loop lines entering and exiting from each set of pulleys extend generally in line or parallel with the forward and rear motion of the horse's legs so that again, restrictive forces are applied in line with the forward and rear motion of the legs without introducing any lateral stress which may otherwise cause potential harm to the horse or have an otherwise adverse effect on the trotting gait.

In each embodiment of the invention, the loop lines are designed to permit adjustment to the length of the lines to regulate the hopple for use with varying sizes of horses and to also control the degree of restriction required to maintain the trotting gait. In addition, the harness structure or hangers which are used to mount the hopples to a horse may permit vertical adjustment of the entire motion transfer assemblies, i.e. pulley systems or rotating shafts as well as the loop lines and hopple loops so that the hopples may be positioned at various points along the vertical height of the horse's legs.

It is a primary object of the present invention to provide a hopple which successfully fetters each pair of the diagonal forward and rear legs of a horse together in such a manner that the horse is restricted or encouraged to move with a trotting gait and wherein the length of the linear motion of the hopple loops and the degree of restriction to the legs of the horse may be effectively controlled by adjustment to the mounting harness, the hangers and the straps associated with the hopple.

It is another object of the present invention to provide a hopple for trotting horses wherein the diagonal front and rear legs are not only fettered together without the application of adverse lateral stress but wherein the two pair of forward and rear leg fetters or control lines are mechanically connected so that the movement of each diagonal tether is in unison with the opposing tether thereby insuring that the horse moves in a uniform manner without hitching or jumping.

BRIEF DESCRIPTION OF THE DRAWINGS

FIG. 4 is a schematic perspective view of the pulley arrangement used in the motion transfer assembly of FIG. 3.

FIG. 6 is a perspective view of the trotting hopple shown in FIG. 5.

FIG. 7 is an enlarged cross sectional view taken along lines 7—7 of FIG. 6.

FIG. 8 is an enlarged cross sectional view taken along lines 8—8 of FIG. 6.

FIG. 9 is a cross sectional view of another embodiment of the invention taken along lines that would be similar to lines 8—8 of FIG. 6 and showing meshing components to interlock the motion transfer members of the hopple.

FIG. 10 is a partial bottom plan view of the motion transfer assembly of FIG. 9.

DESCRIPTION OF THE PREFERRED EMBODIMENT

Figure 1:
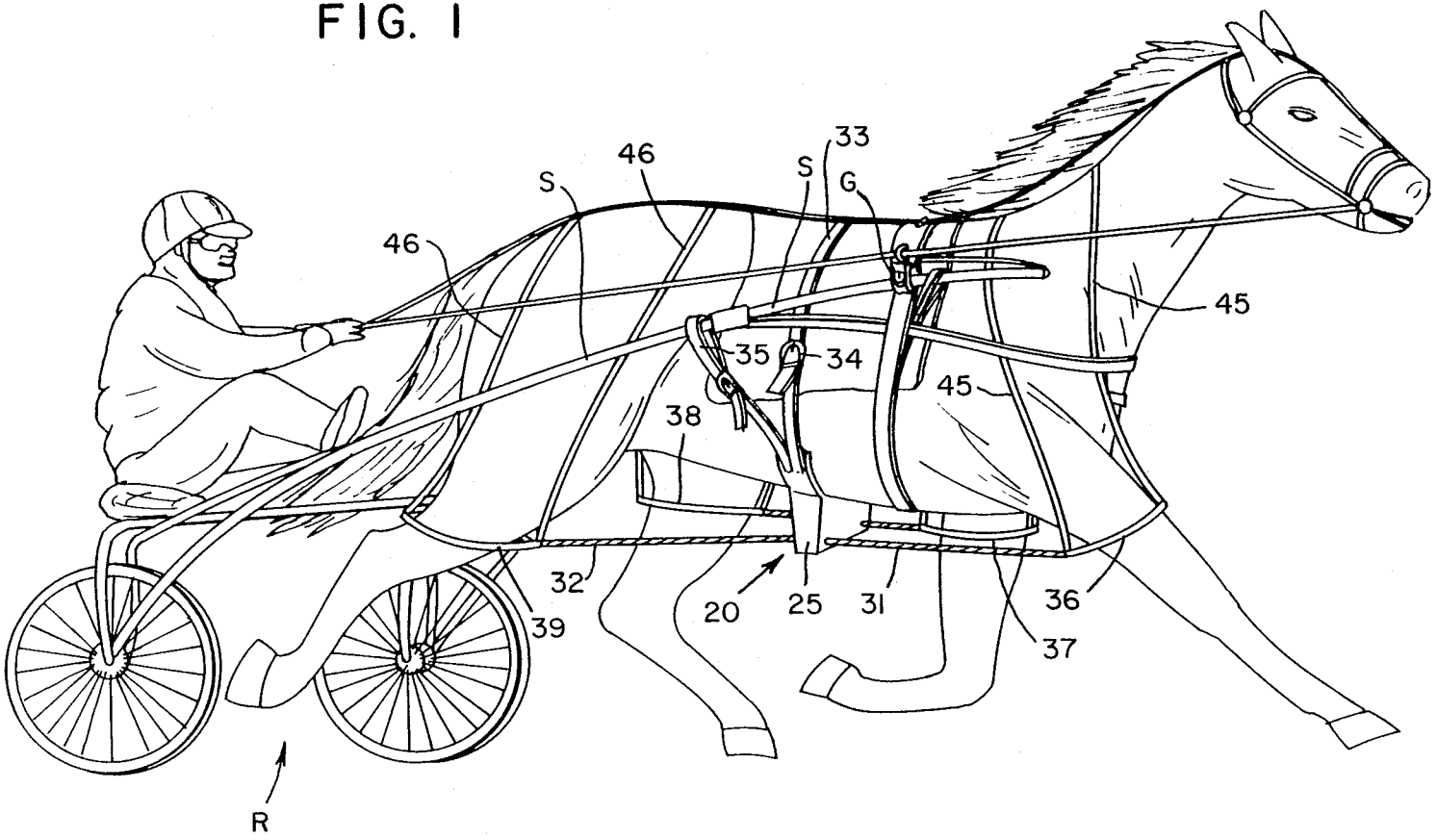
FIG. 1 is a perspective illustrational view of a first embodiment of the present invention showing the hopple being mounted and suspended from the underside of a horse.
Figure 2:
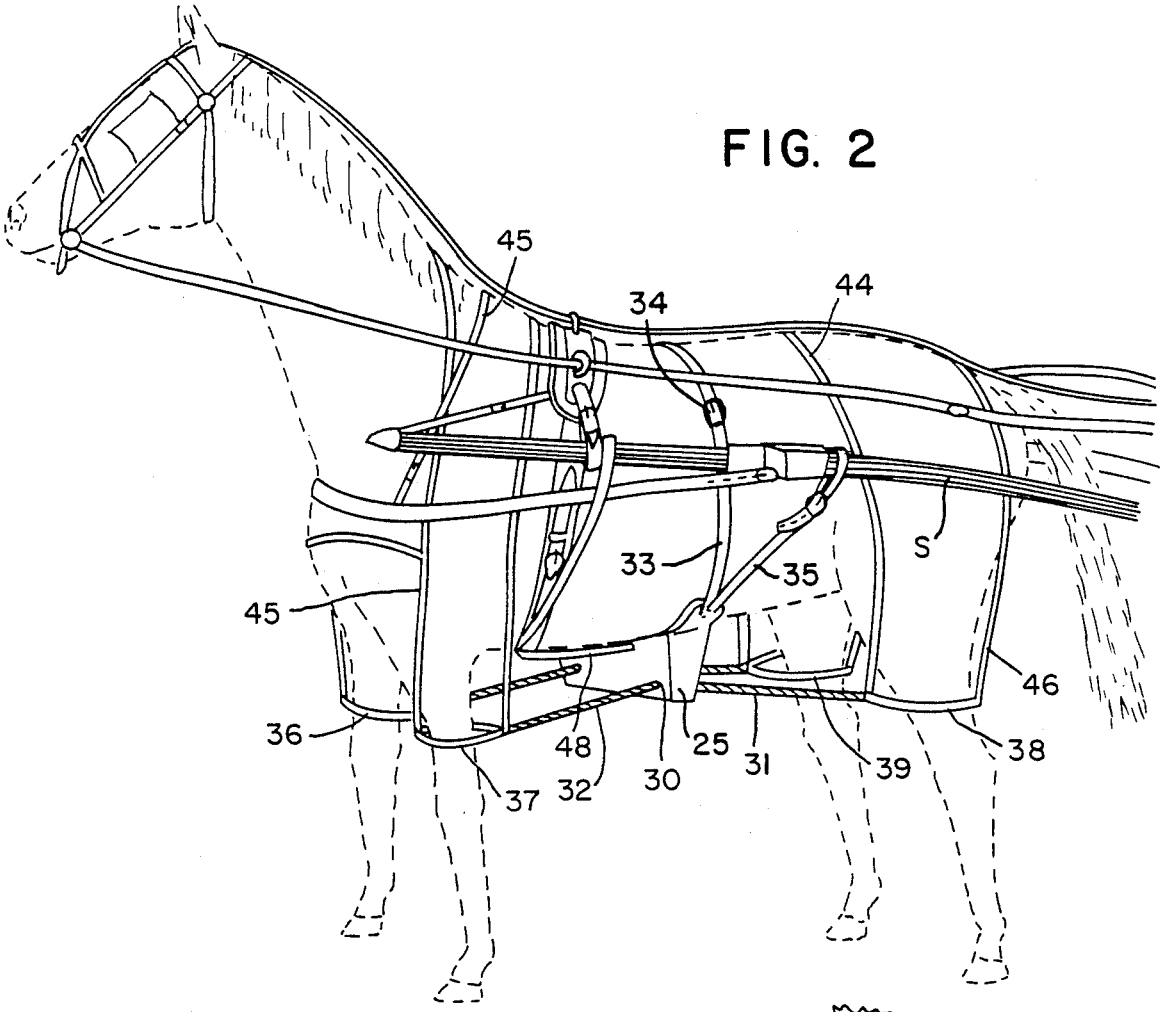
FIG. 2 is a perspective view of the first embodiment of trotting hopple of the present invention.

With continued reference to the drawings, the present invention is directed to trotting hopples which are utilized to regulate the gait of a horse so that the diagonal front and rear legs of the horse move in unison with one another. The drawings reflect several different embodiments for creating an effective structure for a trotting hopple, however, in each of the embodiments shown, it is the purpose of the hopple to secure or fetter the diagonal front and rear legs in such a manner that any restrictive force or stress applied to the horse's legs is applied linearly with respect to the forward and rear motion of the horse during its normal trotting gait and without the application of any type of lateral stress being induced or applied to the horse's legs.

With specific reference to FIGS. 1–4 of the drawings, the preferred embodiment of the present invention is disclosed in detail. In this embodiment, the hopple mechanism includes a motion transfer mechanism or assembly 20 which incorporates two vertically oriented pulley sets 21 and 22 which are mounted in spaced relationship with respect to one another adjacent each side of the belly of the horse about supporting shafts 23 and 24. Each of the shafts 23 and 24 is mounted within an enclosed housing 25 having an upper generally concave surface 26 having a padding material 27 disposed thereon for selective engagement with the belly of the horse. Inside the housing, the shafts 23 and 24 are mounted within supporting plates 28 and 29 which are secured within the housing. The pulley sets 21 and 22 are in spaced horizontal relationship with respect to one another. Forward and rear side openings 30 are provided through the housing adjacent each side of the pulley sets 21 and 22 through which flexible hopple restraint straps, ropes or lines 31 and 32 are selectively extended. (In FIG. 4, 31 reflects a rope while 32 reflects a strap.)

The purpose of the motion transfer assembly 20 of the present invention is to insure that any restraints placed upon the legs of the horse are applied generally linearly with respect to the normal forward and rearward movement of the horse's legs. In this manner, forward and rear motion is allowed to be transmitted transversely with respect to the horse.

To mount the housing 25 to the belly of the horse, a strap assembly 33 is provided which extends outwardly on either side of the housing so as to encircle the horse and be adjustable with respect thereto by buckle element 34. An additional pair of strap members 35 may be extended outwardly of the housing and attached to the shafts S of a racing sulky R and are adjusted so as to stabilize the housing and to prevent any shifting of the housing relative to the horse during use of the hopple.

The hopple of the present invention also includes a pair of forward hopple loops 36 and 37 which are connected by way of the flexible straps or ropes 31 and 32, respectively, through the pulley assemblies 21 and 22 to diagonal rear hopple loops 38 and 39. Each of the hopple loops is of a size to loosely encircle the legs of a horse at a point which is generally 6 to 8 inches down the legs from the body of the horse. The loops are generally formed in an oblong configuration being approximately 6 inches wide on the inside and approximately 12 inches long as measured on the outside. The loops are preferably covered with a suitable protective material which will prevent abrasion to the horse's legs during use of the hopple.

Figure 3:
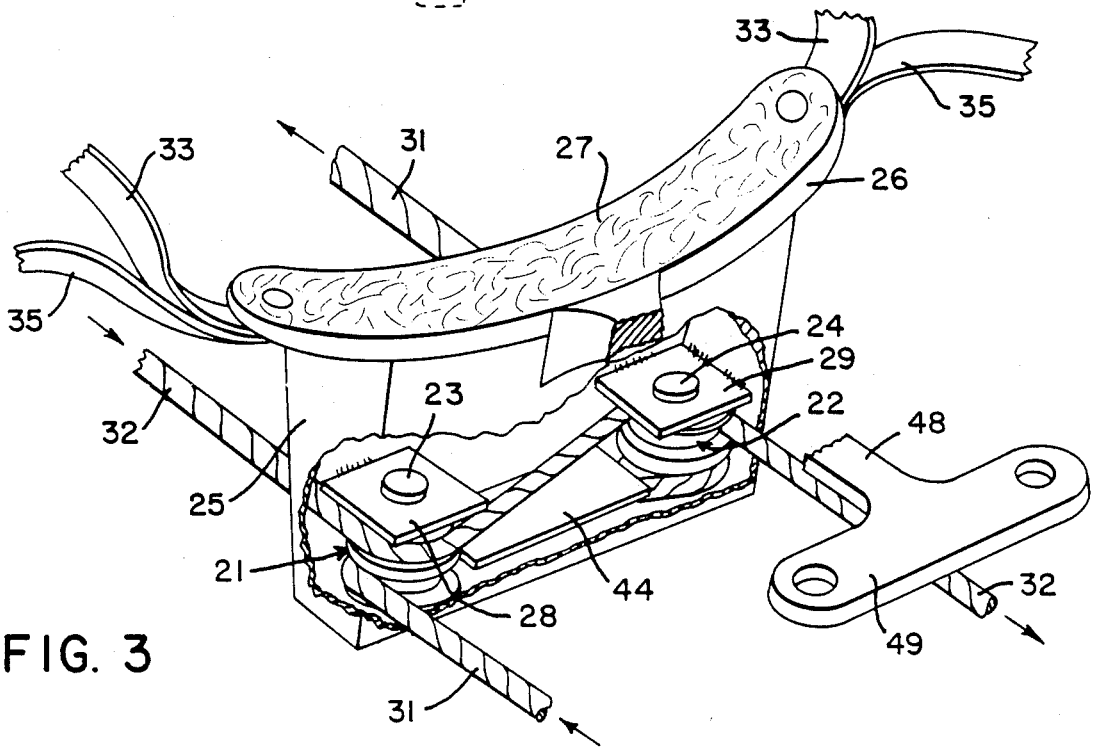
FIG. 3 is an enlarged perspective view having portions broken away of the motion transfer assembly of the trotting hopple of the embodiment of FIGS. 1 and 2.

With particular reference to FIGS. 3 and 4, it is noted that each of the pulley sets 21 and 22 includes an upper and lower pulley wheel which are mounted in vertically spaced relationship with respect to one another on their respective shafts 23 and 24. Pulley set 21 includes upper pulley wheel 40 and lower pulley wheel 41 while pulley assembly 22 includes upper pulley wheel 42 and lower pulley wheel 43. Each of the pulley wheels is of the same size with the pulley wheels 40 and 42 being horizontally aligned and pulley wheels 41 and 43 being horizontally aligned. In order to assure that the straps 31 and 32 are linearly oriented with respect to the legs of the horse, the pulleys must be spaced apart slightly less than the distance between the legs of a horse.

It should be noted that the hopple connecting strap 31 extends from hopple loop 36 around the rear side of pulley wheel 41 and then along the forward side of pulley wheel 43, as shown in FIG. 4 before exiting the opening in the housing and extending to the rear diagonal hopple loop 38. Hopple strap 32, on the other hand, extends from hopple loop 37 around the rear or back side of the upper pulley wheel 42 and then along the forward side of the opposing pulley wheel 40 and rearwardly through the opening in the housing to the rear diagonal hopple loop 39. A rubbing plate 44 is provided between the two sets of pulleys 21 and 22. This precludes the straps or ropes from rubbing on each other. Also the pulley and the associated support structure are designed to eliminate any pulley/strap/rope malfunction. Each of the hopple straps 31 and 32 may include a buckled or adjustable section (not shown) which can be utilized to effectively adjust the length of the straps.

Due to the flexible nature of the belts, ropes or straps 31 and 32, outside and inside hanger straps 45 are provided to vertically support the hopple loops 36 and 37, and outside and inside hanger straps 46 are also provided to vertically support the rear hopple loops 38 and 39. Both pairs of hanger straps 45 and 46 should be made adjustable so as to permit the selective location of the hopple loops with respect to the horse's legs.

To provide further mounting rigidity for the housing for the present invention, a mounting tongue 48 is attached to the housing and extends forwardly thereof from the base of the support 26. The forward end of the tongue includes a T-shaped portion 49 which is connected by rivets or otherwise secured to the girth G which encircles the forward portion of the horse.

With this embodiment, it is not only possible to fetter the diagonal front and rear legs together in such a manner that the restraining forces exerted on the horse's legs are directed linearly with repect to the normal forward and rear motion of the legs, but the embodiment also tends to synchronize the movement of the opposing diagonal legs due to the fact that the hopple loops restrain the legs of the horse symmetrically. Further, with the present embodiment, the entire motion transfer apparatus is neatly contained within a housing in which the sets of pulleys are rotatably supported. An additional advantage of the present embodiment over the embodiments to be discussed hereinafter is that the housing provides protection from dust and dirt which is inherently created as the horse is trained or races and therefore prolongs the longevity of the motion transfer portion of the apparatus and reduces the amount of maintenance required to maintain the hopple in good working condition.

In the use of the first embodiment of the invention, the horse is harnessed in the conventional manner with the girth having the T-shaped head of the hopple assembly fastened to the bottom midpoint. Upon securing the girth strap G to the saddle by means of a buckle, the hopple supporting strap 33 is placed around the barrel of the horse and buckled. The hopple loop hangers are placed on the horse and each hopple lopp in turn has the horse's hoof and leg slipped through and the hopple loops are fastened to the hangers. Suitable adjustments may be made in the length of the connecting linkages or other straps which connect the hopple loops. It is important that the length of each linkage be the same so that the restraint to the stride or stroke of the horse's gait is the same on each leg. The horse now can be hitched to the sulky. The strap members 35 are fastened to the sulky shafts S one on each side. The tension of the straps is adjusted to properly support the hopple mechanism under the belly of the horse without causing discomfort to the horse.

Due to the slack in the hopple loops, the horse is free to walk at a very slow gait but once the horse is given rein, the legs will be confined or restricted so that the horse will assume a trotting gait with the diagonal legs moving simultaneously with respect to one another. As one forward leg moves, the restraint will cause the diagonally disposed hopple loops to be pulled forwardly at the same time. In a like manner, the other diagonal legs of the horse will be moved diagonally due to the connection of the hopple loops through the motion transfer assembly. Further, as the pulleys of the motion transfer assembly are positioned outwardly with respect to the belly of the horse, any motion or restrictive forces will be directed toward the legs of the horse in a linear direction with repect to the forward and rearward motion of the legs thereby preventing any adverse transverse or lateral force from being imparted to the horse's legs. With the hopple, a horse will be confined to move at a trotting gait and will be prevented from developing a full gallop. Regulation in the restriction to the stroke of the horse's gait may be made by raising and lowering the hopple loops or by making adjustment to the restraint straps.

With particular reference to FIGS. 5–8 of the drawings, another embodiment of the invention is disclosed in detail. In this embodiment, the hopple mechanism 110 is shown as including a base portion 111 having a resilient pad 112 secured to the upper surface thereof so as to provide a comfortable buffer between the mounting base 111 and the belly of the horse. The mounting base includes a pair of outer extensions 113 and 114 which have openings therethrough through which a mounting strap 115 is selectively and adjustable extended. The mounting strap includes a buckle element which is utilized to secure the remote or free end of the belt in engagement therewith so as to selectively mount the hopple mechanism to the horse. Also, another pair of straps 116, one on each side, are used to position and support the hopple mechanism by attaching the straps to the sulky shafts, as shown at S. To further secure the hopple in fixed engagement with respect to the horse, a tongue element 118 extends forwardly of the base 111 and is provided with a T-shaped outer end 119 having openings 120 therethrough. The T-shaped outer end portion of the tongue is selectively rivetted or otherwise secured to the girth G which encircles the horse forwardly of the mounting strap 115.

A motion transfer assembly 122 is mounted to the lower surface 123 of support plate 111. The motion transfer assembly includes an outer hollow shaft 124 which is carried within a bearing element 125 which is secured to the mounting plate as shown at 126 by any suitable fastening means. A second shaft 127 is disposed through the outer shaft 124 and is rotatably movable with respect thereto. It should be noted that both the outer and inner shafts 124 and 127 are oriented generally perpendicularly with respect to the tongue element 118 so that the shafts extend generally perpendicularly to the length of the horse and extend generally outwardly to a point which is in general alignment with the front and rear legs on either side of the horse. A pair of generally downwardly oriented levers or crank arms 128 and 129 and 130 and 131 are connected to each of the shafts 124 and 127, respectively. The levers extend from the outermost portions of the shafts so as to be in substantial alignment with the front and rear legs of a horse when the hopple is mounted to the horse.

The length of the levers 128–131 will vary depending upon the hopple stroke which is desired to be achieved with a given horse. By way of example, a generally standardized size would cause the levers to be spaced with the inside levers 128 and 129 being at approximately 12½ inches with respect to one another and the outer levers 130 and 131 at about 14 inches with respect to one another. In addition, in a standard hopple, the levers would be approximately 8 inches long as measured from the rotational center of each end of the levers. In this manner and utilizing 8 inch levers, a stroke or stride of approximately 15 inches is achievable which is generally adequate for most trotting horses.

The hopple further includes a pair of forward hopple loops 133 and 134 and rear hopple loops 135 and 136. As with the previous embodiment, each of the hopple loops is of a size to loosely encircle the legs of a horse at a point which is generally 6 to 8 inches down the legs from the body of the horse and are preferably covered with a suitable material which will prevent abrasion to the horse's legs during the use of the hopple.

Figure 5:
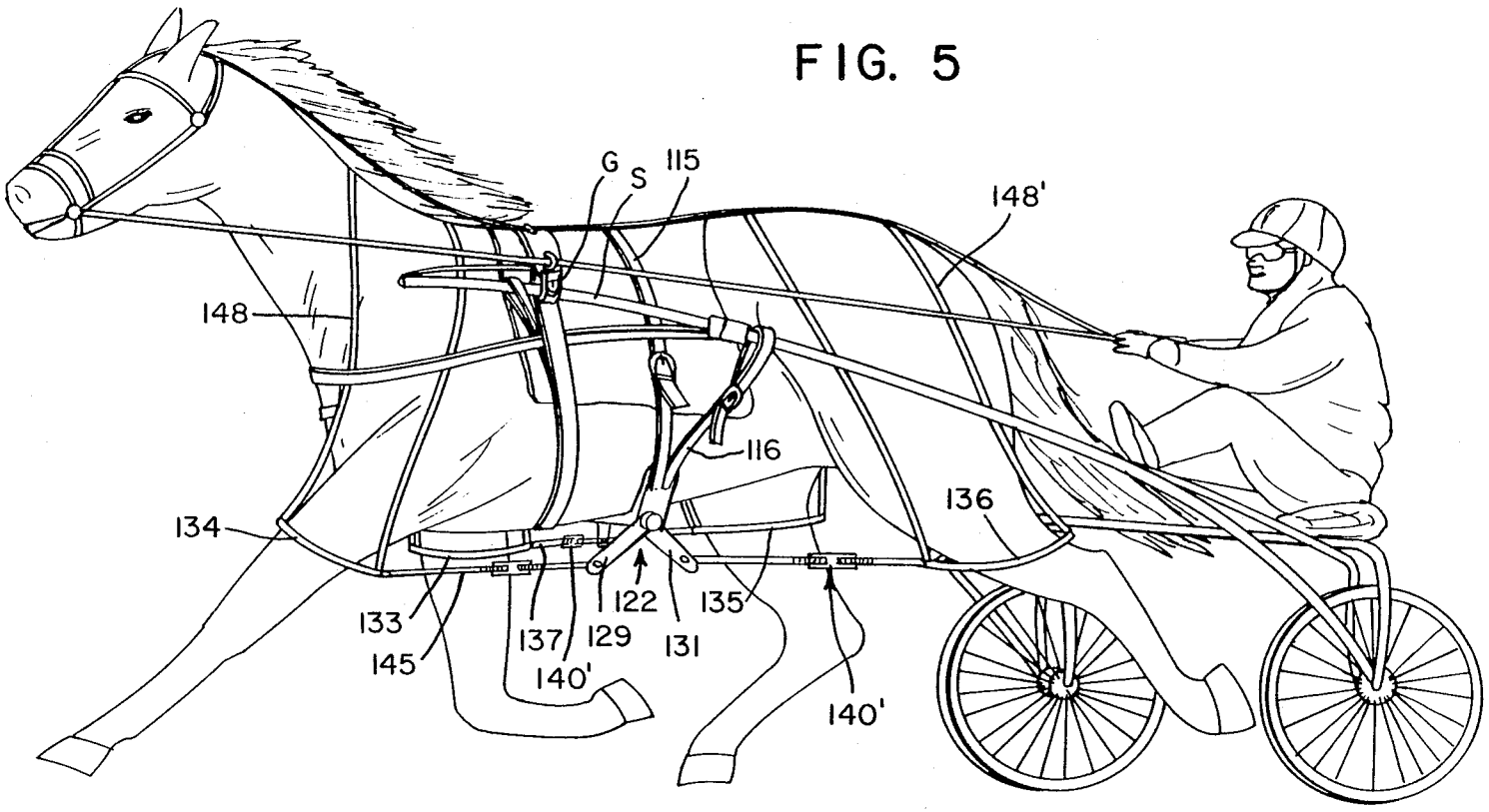
FIG. 5 is a perspective view of a second embodiment of trotting hopple shown as being mounted to a horse.

In order to connect the hopple loops so as to control the gait of the horse to a trot, the forward hopples 133 and 134 are connected through the motion transfer assembly 122 so as to be connected for simultaneous movement with the diagonal rear hopple loops 136 and 135, respectively. Hopple loop 133 is connected to the outer lever 130 associated with the inner shaft 127 by way of a loop line or linkage 137. The linkage member 137 may include a pair of link arms shown as 138 and 139 which are selectively adjustable along elongated slots 140 formed in each of the links or can be adjusted by turnbuckles 140' (as shown in FIG. 5) or other suitable adjusting devices. Suitable fasteners such as nuts and bolts are provided to secure the links in adjusted position relative to one another. The remote end of the linkage member 137 is pivotally connected at 142 to the lever 130 while the opposite end thereof is secured to the hopple loop 133.

Hopple loop 136 which is the rear diagonal loop with respect to hopple loop 133 is connected by a linkage member 144 to the opposing lever 131 of the shaft 127. Link member 144 is designed with the same adjustment features as disclosed with respect to linkage member 137.

Hopple loop 134 is connected by way of a linkage member 145 which is pivotally secured at its outermost end to lever 129 of the outer shaft 124 while hopple loop 135 is connected by linkage 146 to the opposing inner lever 128 of shaft 124. Both linkages 145 and 146 include the same adjustment features as were disclosed with respect to linkage member 137.

With respect to FIG. 5 of the drawings, each of the forward hopple loops 133 and 134 is vertically suspended from the horse by way of a hanger 148 which is suspended from the withers of the horse and is connected to each of the hopple loops adjacent the forward portions thereof. The hanger 148 is adjustable as with a buckle so that the vertical placement of the hopple loops 133 and 134 may be adjusted as desired. Also, the rear hopple loops 135 and 136 are adjusted in the same manner by means of a hanger 148' suspended from the hind quarter of the horse. In the embodiment shown, because rigid links 137, 144, 145 and 146 are used to connect the hopple loops to the levers of the motion transfer assembly 122, it is generally not necessary to provide an inside hanger for hopple loops 133, 134, 135 and 136. In some instances, however, it may be necessary to provide inside and outside hangers for all the loops (as shown in FIG. 5) especially if the hopple linkages are formed of a flexible strap or cord-like material as opposed to the fairly rigid metal or plastic material as illustrated in FIG. 6. When flexible belts or straps are utilized to join the levers to the hopple loops, buckles are provided for adjusting the length of the straps.

In the construction of the hopple of this and the prior embodiment, the housings, pulleys, levers and shafts may be made of a lightweight but durable metallic material or may be made of a suitable plastic material. If plastic materials are used, it may be unnecessary to provide bearings between the rotating shafts whereas if metal is used to form the various shafts, some type of bearing support between the members may be necessary.

With respect to FIGS. 9 and 10 of the drawings, a third embodiment of the invention is disclosed. In this embodiment, the hopple support and mounting straps remain generally the same as disclosed with respect to the embodiment of FIGS. 5–8. In this embodiment, however, instead of providing the shafts 124 and 127 in concentric relationship about a common axis, the rotating shafts are spaced in generally parallel relationship with respect to one another In this embodiment, the shafts are identified as 124' and 127'.

Each of the shafts 124' and 127' include outer end portions which are mounted within pairs of opposing bearing block assemblies 150 and 151 which are in turn mounted or secured to the lower surface 123' of the base or support member 111'. As in the second embodiment, each of the shafts 124' and 127' supports a pair of downwardly depending levers. Levers 130' and 131' depend from shaft 127' while levers 128' and 129' depend from shaft 124'. In this respect, lever 130' is connected via linkage system 137' to a front hopple loop which would be similar to that shown at 133 in FIG. 5 whereas lever 131' would be pivotally connected with linkage 144' which is connected to a diagonally rear hopple loop such as shown at 136 in FIG. 5. In a like manner, the lever 129' would be connected through a linkage system 145' to a forward hopple loop such as that shown at 134 in FIG. 5 while lever 128' is connected via linkage 146' with a rear diagonally oriented hopple loop such as that shown in 135 of FIG. 5. Each of the linkages which connects the levers with the corresponding hopple loop will have the same adjustable features as were discussed with respect to the first embodiment.

In this embodiment, the motion transfer assemby 122' is designed to coordinate or intermesh the motion of each of the shafts 124' and 127' so that they move simultaneously with one another. In order to accomplish this arrangement, one end of each of the shafts 124' and 127' has a gear element 152 and 153 secured thereto adjacent one of the bearing blocks which connect the shafts to the support 111'. The gear elements 152 and 153 are shown as being intermeshed with one another so that each shaft must simultaneously rotate relative to the other simultaneously. Therefore, any rotational movement of shaft 124' will cause a simultaneous and opposite movement in shaft 127'. In this manner, the movement of each of the hopple loops will be regulated and controlled throughout the entire assembly so that the stroke of each loop will be the same regardless of which leg or which hopple loop is being discussed.

The preferred and alternate embodiments of the present invention have been tested for use with trotting horses and have been found successful in regulating the trotting gait of such horses. The tests to date indicate that after a very short period of time, the horses will adapt to the restrictive force or constraints being applied by the hopple loops and will assume the proper diagonal trotting gait. Further, any tendency for the horse to gallop is effectively prevented by the restraint of the hopple mechanism on the movement of the horse's legs.

I claim:

1. A hopple for developing the trotting gait of a horse by fettering the legs diagonally comprising a pair of forward loop means and a pair of rear loop means, each of said forward and rear loop means being of a size to loosely encircle one of the legs of the horse, first connector means extending between a first of said forward loop means and a diagonally oriented and first of said rear loop means, second connector means extending from a second of said front loop means to a diagonally oriented and second of said rear loop means, each of said first and second connector means having at least first and second offset sections, a motion transfer assembly, means for mounting said motion transfer assembly beneath the horse, said motion transfer assembly having first means for substantially aligning said first and second sections of said first connector means in generally linear relationship with respect to the forward and rearward motion of a first pair of diagonally oriented legs of the horse and second means for substantially aligning said first and second sections of said second connector means in linear relationship with the forward and rearward motion of the other pair of diagonally oriented legs of the horse whereby said first connector means and said first forward and rear loop means will restrict one set of diagonal legs of the horse to move in unison while the second connector means and said second forward and rear loop means will cause the other set of diagonal legs of the horse to move in unison and without the application of adverse lateral stress to the horse's legs.

2. The hopple of claim 1 including a first hanger means, said first hanger means including first and second end portions, said first end portion being connected to said first forward loop means and said second end portion being connected to said second of said forward loop means whereby said forward loop means may be suspended from the forward shoulders of the horse.

3. The hopple of claim 2 in which said first hanger means includes adjustment means for vertically adjusting the height of said first and second forward loop means with respect to the legs of a horse.

4. The hopple of claim 3 including a second hanger means, said second hanger means including end portions, means for connecting said end portions with said first and second rear loop means so that said rear loop means are vertically supported with respect to the rear legs of the horse.

5. The hopple of claim 4 in which said second hanger means includes adjustment means for vertically altering the height of said first and second rear loop means with respect to the horse's rear legs.

6. The hopple apparatus of claim 1 including a base means, said motion transfer means being supported by said base means, a tongue extending forwardly of and connected to said base means, a harness means, means for connecting said tongue to said harness means, said harness means being of a size to encircle the horse so as to retain said tongue means in generally fixed relationship with respect thereto.

7. The hopple apparatus of claim 6 including strap means connected to said base means, said strap means being of a size to encircle the shafts of a sulky to support and stabilize said base means.

8. The hopple apparatus of claim 7 in which said base means includes a generally concave upper surface, and padding means attached to said upper surface of said base means.

9. The hopple apparatus of claim 1 in which said motion transfer assembly includes a first and second set of vertically spaced pulley means, each of said sets of pulley means including upper and lower pulley wheels which are mounted on a vertically oriented shaft means, said first and second sets of pulley means being in spaced and generally aligned horizontal relationship adjacent each side of the horse so that the outermost portions of said upper and lower pulley wheels of said first set of said pulley means are generally aligned with the front and rear legs of one side of the horse while the outside of said upper and lower pulley wheels of said second set of pulley means are generally aligned with the opposite outside legs of the horse, said first connector means including a flexible strap means extending from said first forward loop means about said upper pulley wheel of said first set of pulley means and around the horizontally aligned upper pulley wheel of said second set of pulley means to said first rear loop means, and said second connector means extending from said second forward loop means around said lower pulley wheel of said second set of pulley means and around the horizontally aligned lower pulley wheel of said first set of pulley means to said second rear loop means.

10. The hopple apparatus of claim 9 including a housing, means for rotatably supporting said first and second sets of said pulley means within said housing, and openings in said housing for said first and second connector means to pass therethrough.

11. The hopple structure of claim 10 in which each of said first and second sections of said first and second connector means are adjustable.

12. The hopple apparatus of claim 10 in which at least one of said first and second sections of said first and second connector means is adjustable.

13. The hopple structure of claim 1 in which said motion transfer assembly includes a first generally hollow rotatable shaft means, means for mounting said rotatable shaft means to a base means, a second rotating shaft means disposed within said first shaft means and being rotatable with respect thereto, a first set of depending lever means extending from opposite ends of said first shaft means, a second set of depending lever means extending from opposite ends of said second shaft means, said first section of said first connector means connecting said first forward loop means with one of said lever means of said first shaft means and said second section of said first connector means connecting the opposite of said lever means of said first shaft means with said first rear loop means, said first section of said second connector means connecting said second forward loop means with one of said lever means of said second shaft means and said second section of said second connector means connecting the opposite of said lever means of said second shaft means with said second rear loop means.

14. The hopple of claim 1 in which said motion transfer means includes a base means and first and second generally parallel shafts, means for mounting said first and second shafts to said base means so as to be rotatable with respect thereto, each of said first and second shafts having a pair of downwardly oriented lever means extending from adjacent each end thereof, said first section of said first connector means extending between said first forward loop means and one of said lever means of said first shaft and said second section of said first connector means connecting the other of said lever means of said first shaft with said first rear loop means, said first section of said second connector means connecting said second forward loop means with one of said levers of said second shaft and said second section of said second connection means connecting the other of said lever means of said second shaft with said second rear loop means, and means mounted to each of said first and second shafts for causing said first and second shafts to rotate simultaneously with respect to one another.

15. The hopple of claim 14 in which said means for causing said first and second shaft means to rotate simultaneously includes first and second gear means, said first and second gear means being in meshed relationship with one another.

16. A hopple for developing the trotting gait of a horse by fettering the legs diagonally comprising first and second forward loop means for selectively encircling the front legs of the horse, first and second rear loop means for selectively encircling the rear legs of a horse, said first forward loop means and said first rear loop means being diagonally oriented with respect to one another and said second forward loop means and said second rear loop means being diagonally related with respect to one another, first connector means extending between said first forward and rear loop means and second connector means for extending between said second forward and said rear loop means, each of said first and second connector means having first and second generally offset sections which are oriented generally parallel to one another, each of said offset sections of said first and second connector means being joined by an intermediate connector section which extends generally perpendicular therebetween, first mounting means for supporting said intermediate section of said connector means to the horse whereby said first and second sections of said first and second connector means are aligned generally parallel with respect to the movement of the legs of the horse in a forward and rear direction.

17. The hopple of claim 16 including a second mounting means for connecting said first and second forward loop means in selectively spaced relationship with respect to the forward legs of the horse.

18. The hopple of claim 17 including third mounting means for supporting the first and second rear loop means in selective vertical relationship with respect to the rear legs of the horse.

19. The hopple of claim 16 in which said intermediate section of said first and second connector means is guided by two pairs of spaced pulley means, each of said pulley means having an upper and lower pulley wheel mounted about a common shaft, means for supporting said shafts in rotatable relationship with respect to said first mounting means, said intermediate section of said first connector means extending partially around each of said upper pulley wheels and said intermediate section of said second connector means extending partially around each of said lower pulley wheels whereby the first and second connector means restrain the diagonal legs of the horse to move in unison.

20. The hopple of claim 16 including means for synchronizing the movement of said first and second connector means so that first and second connector means are displaceable simultaneously in opposite directions with respect to one another.

21. The hopple of claim 16 in which said intermediate section of said first and second connector means includes first and second rotatable shafts carried by said first mounting means, a pair of spaced lever means depending from each of said first and second rotatable shafts, said first and second sections of said first connector means being connected to said depending lever means of said first rotatable shaft, and said first and second sections of said second connector means being connected to said depending levers of said second rotatable shaft.

* * * * *